US007793589B2

(12) United States Patent
Nadolny et al.

(10) Patent No.: US 7,793,589 B2
(45) Date of Patent: Sep. 14, 2010

(54) CLOTH FEED CONTROL UNIT OF A CLEANING DEVICE FOR PRINTING MACHINE CYLINDERS

(75) Inventors: Siegbert Nadolny, Meitingen (DE); Werner Ackermann, Aschaffenburg (DE)

(73) Assignee: Baldwin Germany GmbH, Friedberg (DE)

( * ) Notice: Subject to any disclaimer, the term of this patent is extended or adjusted under 35 U.S.C. 154(b) by 265 days.

(21) Appl. No.: 11/846,956

(22) Filed: Aug. 29, 2007

(65) Prior Publication Data

US 2008/0105150 A1 May 8, 2008

(30) Foreign Application Priority Data

Sep. 7, 2006 (DE) ..... 10 2006 041 894

(51) Int. Cl.
*B41F 35/00* (2006.01)

(52) U.S. Cl. ..... 101/425; 101/483

(58) Field of Classification Search ..... 101/425, 101/483

See application file for complete search history.

(56) References Cited

U.S. PATENT DOCUMENTS

| | | | | |
|---|---|---|---|---|
| 4,344,361 | A | 8/1982 | MacPhee et al. | |
| 4,649,818 | A | 3/1987 | Switall et al. | |
| 5,275,104 | A | 1/1994 | Corrado et al. | |
| 5,519,914 | A * | 5/1996 | Egan | 15/256.53 |
| 5,758,577 | A * | 6/1998 | Ebina | 101/423 |
| 6,616,084 | B1 * | 9/2003 | Sitzmann | 242/534 |
| 6,734,888 | B1 * | 5/2004 | Mindler et al. | 347/217 |
| 6,832,866 | B2 * | 12/2004 | Klinefelter et al. | 400/668 |
| 2002/0000168 | A1 * | 1/2002 | Fuseki et al. | 101/425 |
| 2004/0226465 | A1 * | 11/2004 | Morke et al. | 101/483 |

FOREIGN PATENT DOCUMENTS

| | | | |
|---|---|---|---|
| DE | 44 42 412 | A1 | 5/1996 |
| DE | 100 44 861 | A1 | 5/2001 |
| DE | 101 60 197 | A1 | 6/2003 |
| DE | 103 27 888 | A1 | 1/2005 |
| DE | 10 2005 003 166 | A1 | 7/2006 |
| EP | 0 755 789 | A | 1/1997 |

OTHER PUBLICATIONS

Jan. 1, 2006 German Office Action.
Feb. 13, 2008 European Office Action.

* cited by examiner

*Primary Examiner*—Anthony H. Nguyen
(74) *Attorney, Agent, or Firm*—Day Pitney LLP

(57) ABSTRACT

Cloth feed control unit of a cleaning device for printing machine cylinders. Provided is a position sensor (30), which generates signals linearly in proportion to the radial variations in the distance of the peripheral surface of a cleaning roller (8, 10) from the position sensor (30). The signals can be used to calculate the length of a cleaning cloth that is on a cloth roller and/or to control the cloth feed. The cloth feed control is carried out preferably in combination with signals of an encoder (44), which detects the rotation-increments of a cloth roller.

15 Claims, 2 Drawing Sheets

CLOTH FEED CONTROL UNIT OF A CLEANING DEVICE FOR PRINTING MACHINE CYLINDERS

The invention relates to a cloth feed control unit of a cleaning device for printing machine cylinders, as disclosed in the preamble of claim 1.

Furthermore, the invention relates to a cleaning device, which exhibits such a cloth feed control unit.

The invention also relates to a control system, which includes two or more cloth feed control units for correspondingly two or more cleaning devices for printing machine cylinders in a printing machine, e.g., an offset press.

The cleaning devices are designed for positioning in a rotational manner two cloth rollers, of which the one cloth roller is a clean cloth roller, and the other cloth roller is a dirty cloth roller. The dirty cloth roller can be driven automatically in a step-by-step manner by a drive, for example, by a pneumatic cylinder, in order to transfer the cleaning cloth in a step-by-step manner by a predetermined cloth feed length from the clean cloth roller to the dirty cloth roller. During a cleaning process the cleaning cloth is transported again at least once, preferably several times by the predetermined cloth feed length, so that each time a cleaner section of cloth is brought into contact with the cylinder periphery of the printing machine cylinder to be cleaned. The cleaning cloth can be dry or moist. The cleaning cloth can be moist just on the clean cloth roller; or, only after it is on its way to the dirty cloth roller, it can be moistened in a spot that is located upstream of the point at which the cleaning cloth can be pressed against the cylinder periphery with a pressing element.

BACKGROUND ART

The DE 10 2005 003 166 A1 discloses a washing apparatus for a printing machine. It includes an ultrasonic sensor for detecting the cloth level of a cleaning cloth roller. In this manner it is determined when the cleaning cloth roller has on hand only a predetermined short amount of remaining cloth, which would no longer be adequate for a new printing process. This procedure avoids having to interrupt a printing process because there is no longer sufficient cleaning cloth until the end of the printing process.

One of several embodiments of a cleaning device for printing machine cylinders is disclosed in the DE 10160 197 A1.

An automatic cylinder cleaning device for printing machines is also disclosed in the U.S. Pat. No. 4,344,361.

BRIEF DESCRIPTION OF THE INVENTION

The invention solves the problem of designing a cleaning device and, in particular, its control unit for cleaning printing machine cylinders in such a manner that a more efficient use of the cleaning cloth is possible.

This problem is solved by the invention with the features of claim 1.

Other features of the invention are disclosed in the dependent claims.

Furthermore, the problem is solved by the invention with a cleaning device that is provided with a cloth feed control unit, according to the invention.

The invention also relates to a control system, which includes two or more cloth feed control units for correspondingly two or more cleaning devices for printing machine cylinders.

Correspondingly the invention also relates to a system, which includes two or more cleaning devices for cleaning printing machine cylinders and a corresponding number of cloth feed control units.

The invention includes a plurality of features, which can be applied individually and in combination in an advantageous manner:

A non-contact sensor, preferably an ultrasonic sensor, scans the peripheral surface of one of the two cloth rollers, preferably the clean cloth roller, and generates—as a function of the detected distance—a signal, in particular, an electric current intensity or as an alternative a voltage level, that corresponds to the radius of the cloth roller. The sensor is designed preferably in such a manner that any variation in the distance results in a linear change in the signal value. The resulting radius is used automatically to calculate the circumference of the cloth roller. The calculated circumference of the cloth roller is set in relation to a defined cloth feed length (cloth feed length-desired value) by means of a number of increments defining the total circumference of the cloth roller. The defined cloth feed length is the cloth feed length, by which the cloth is to be conveyed from the clean cloth roller in the direction of the dirty cloth roller at every feed increment. In the case of a decimal value, the value that is to be found for the number of increments that are to be traveled and that are necessary for the feed of the defined cloth feed length is rounded up to the nearest whole number, for example starting from a decimal value of 0.5; otherwise, rounded down to the nearest whole number. If the active cloth feed has reached the determined value of the increments, the cloth feed is automatically terminated, for example, by deactivating a valve, by means of which compressed air can be fed to a pneumatic drive.

According to another idea of the invention, the number of increments traveled during one cloth feed increment is added up and stored in a summation memory. The stored number of increments can be used for a number of different purposes, for example for calculating automatically the length of cloth that has been used or the remaining length of cloth that is still on the clean cloth roller and/or for generating a signal, when there is only a predetermined minimum length of cloth remaining on the clean cloth roller.

An especially advantageous use of the summation values of increments traveled that are stored in the summation memory lies in the possibility of calculating automatically an average value from the summation values of two or more cleaning devices of a printing machine and determining this average value as the desired value for all cleaning devices inside the same printing machine. The difference between the increments that are traveled and stored in the summation memory and the desired value is determined for all cleaning devices, and this difference is also stored. In the event that the difference deviates upwardly or downwardly from a defined threshold value in a cleaning device, the number of increments to be traveled is adapted by an increase or decrease through the number of increments to be determined as a function of the cloth roller diameter during at least the cloth feed of the next cloth feeds in the same cleaning process or the next cleaning process, to the effect that the total number of traveled increments of the various cleaning devices is corrected again or the total number of traveled increments is the same again in all cleaning devices. At the same time it must be ensured that in reducing the number of increments during one cloth feed a defined minimum value of increments is not undershot.

Thus, it is guaranteed that there is always a sufficient amount of cleaning cloth at the printing machine cylinder to be cleaned.

The cleaning devices are usually referred to as washing beams, since they extend in a manner analogous to a beam transversely across the printing machine in essence over the same length as the printing machine cylinder to be cleaned.

ADVANTAGES OF THE INVENTION

The invention dispenses with the mechanical parts that were required in the past: for example, cloth end limit levers, cloth feeler spoons or ratchet wheels with a drive roller. In contrast to these parts, the invention does not experience any malfunctions as a consequence of fouling, since all of the parts that are necessary according to the invention can be housed in a protected chamber. Furthermore, the prior art parts have the drawback that they can be bent or broken off due to external action on the printing machine. These drawbacks are also avoided with the invention.

The invention is described below with reference to the drawings with the aid of preferred embodiments as examples.

Figure 1:
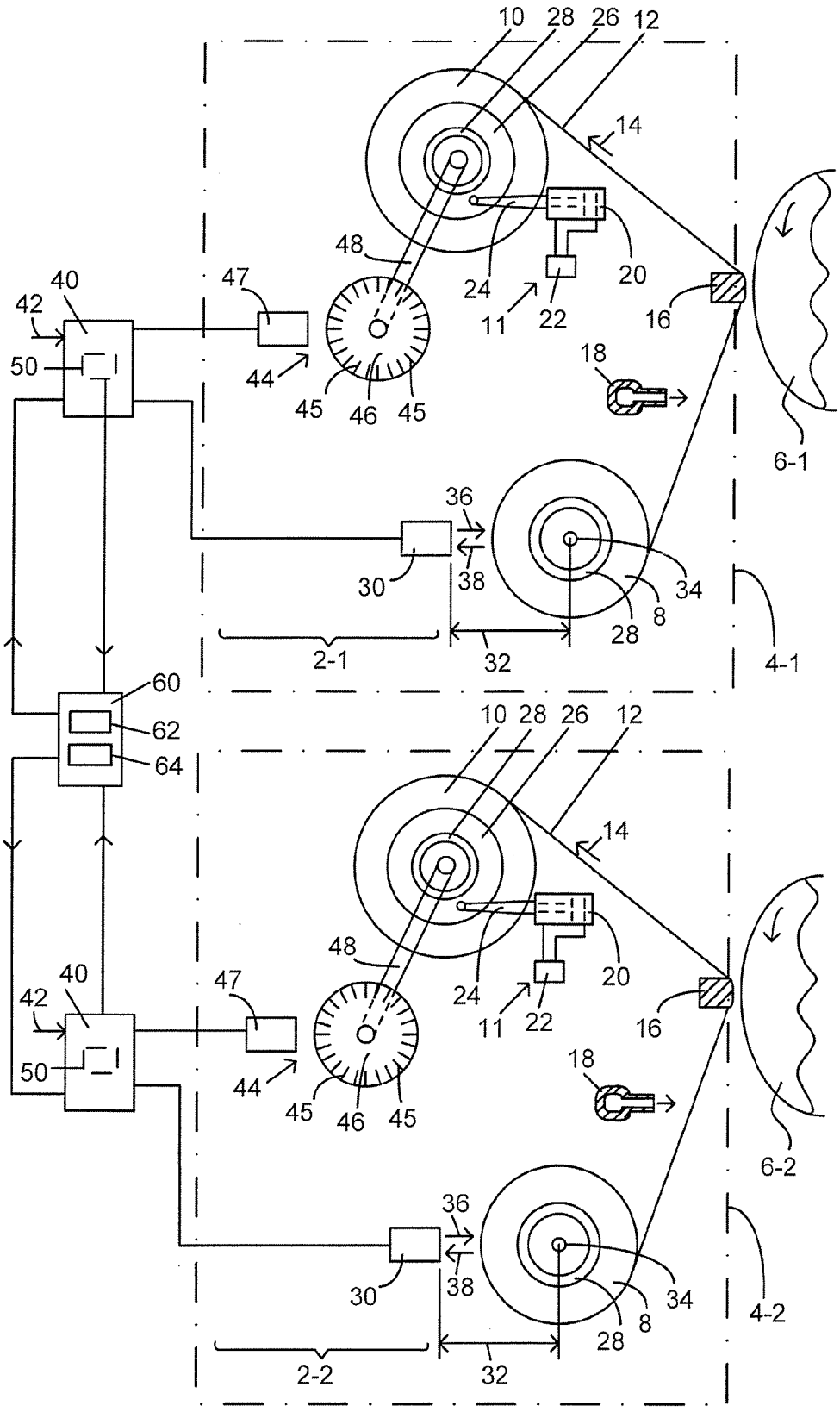
FIG. 1 is a schematic drawing of a cleaning system with two (or more) cleaning devices and related cloth feed control units according to the invention, which form together a control system according to the invention.

FIG. 1 is a schematic drawing depicting two cloth feed control units 2-1 and 2-2 for a commensurate number of cleaning devices 4-1 and 4-2 for cleaning correspondingly also two printing machine cylinders 6-1 and 6-2 of a printing machine, for example, an offset press. Since both cloth feed control units 2-1 and 2-2 as well as the two cleaning devices 4-1 and 4-2 can be designed identically, only the one cloth feed control unit 2-1 for the one cleaning device 4-1 is described below, unless stated otherwise below.

The cleaning device 4-1 extends in essence over the entire length analogous to the printing machine cylinder 6-1 that said cleaning device is supposed to clean. Said cleaning device is designed for rotational positioning of two cloth rollers, of which the one is a clean cloth roller 8 and the other is a dirty cloth roller 10. The dirty cloth roller 10 is rotated in a step-by-step manner by an automatic drive unit 11, in order to transport a predetermined cloth feed length from the clean cloth roller 8 to the dirty cloth roller 10. In so doing, the roller diameter of the two cloth rollers 8 and 10 changes. On the transport path of the cleaning cloth 12 in the direction of transport 14 there is a press element 16 for pressing the cleaning cloth 12 against the printing machine cylinder 6-1 that is to be cleaned. Furthermore, a liquid spray unit 18 can be provided for spraying the cleaning cloth 12 with a liquid, for example water and/or a cleaning agent. For a cleaning process, the cleaning cloth 12 is brought at least once or multiple times into contact with the cylinder peripheral surface of the printing machine cylinder 6-1 by means of the press element 16 and/or by shifting the entire cleaning device 4-1 and then removing it again from the said cylinder. After each contact with the printing machine cylinder (or according to another embodiment, during contact) the cleaning cloth continues to be transported by the predetermined cloth feed length in one working step.

The drive unit 11 can be designed in a number of different ways. It can include, for example, an electric stepper motor or a pneumatic drive 20 (piston-cylinder unit), the piston of which is controlled by a valve 22 in such a manner that it can be moved axially back and forth. Said piston drives by means of a drive connection 24 a free wheel 26, which is connected in a drive relationship to a cloth roller core 28 of the dirty cloth roller 10.

The cloth feed control device 2-1 includes a position sensor 30, which works in a non-contact mode. The position sensor 30 is designed for generating signals, preferably analog signals, in the form of an electric current value or an electric voltage value as a function of the respective radial distance of the position sensor 30 from the outer circumference of one of the two cloth rollers, for example the clean cloth roller 8 (or the dirty cloth roller 10). The signals of the position sensor 30 vary linearly in proportion to the radial variations of the distance of the outer circumference of the cloth roller from the position sensor 30. The position sensor 30 is positioned radially to the rotational axis 34 at a defined distance 32 from the rotational axis 34 of the clean cloth roller 8, so that the analog signals of the position sensor 30 correspond to the respective radius of the cloth roller, even though the position sensor 30 actually detects only its distance from the peripheral surface of the cloth roller. The position sensor 30 is preferably an ultrasonic sensor, whose sound runtime from the position sensor 30 to the peripheral surface of the cloth roller and back again is a measure for the distance. FIG. 1 is a schematic drawing of the ultrasonic beam 36 that was sent and the ultrasonic beam 38 that was reflected.

Furthermore, the cloth feed control unit 2-1 includes a control element 40, which is connected to the position sensor 30, whose analog signal, which corresponds to the radius of the detected clean cloth roller 8, is used to calculate the respective size of the circumference of this clean cloth roller 8. A cloth feed-desired value 42 is stored or can be stored in the control element 40. Said desired value indicates how large the cloth feed length shall be for one feed increment. Furthermore, a predefined number of increments for a 360° revolution of the cloth roller 8 are stored in the control element 40. In other words: the circumference of the cloth roller 8 of 360° is divided into rotational angle increments of equal size.

The control element 40 is designed for calculating by how many increments the cloth roller 8 has to be rotated in order for the drive unit 11 to transport, given the calculated size of the circumference of the cloth roller 8, the cleaning cloth by a cloth feed length that corresponds to the desired value. For this reason the control element 40 is designed to generate an actuating signal-desired value for the drive unit 11 that matches the calculated increments.

The control element 40 is provided preferably with at least one processor for executing the calculations and with a data memory.

Figure 2:
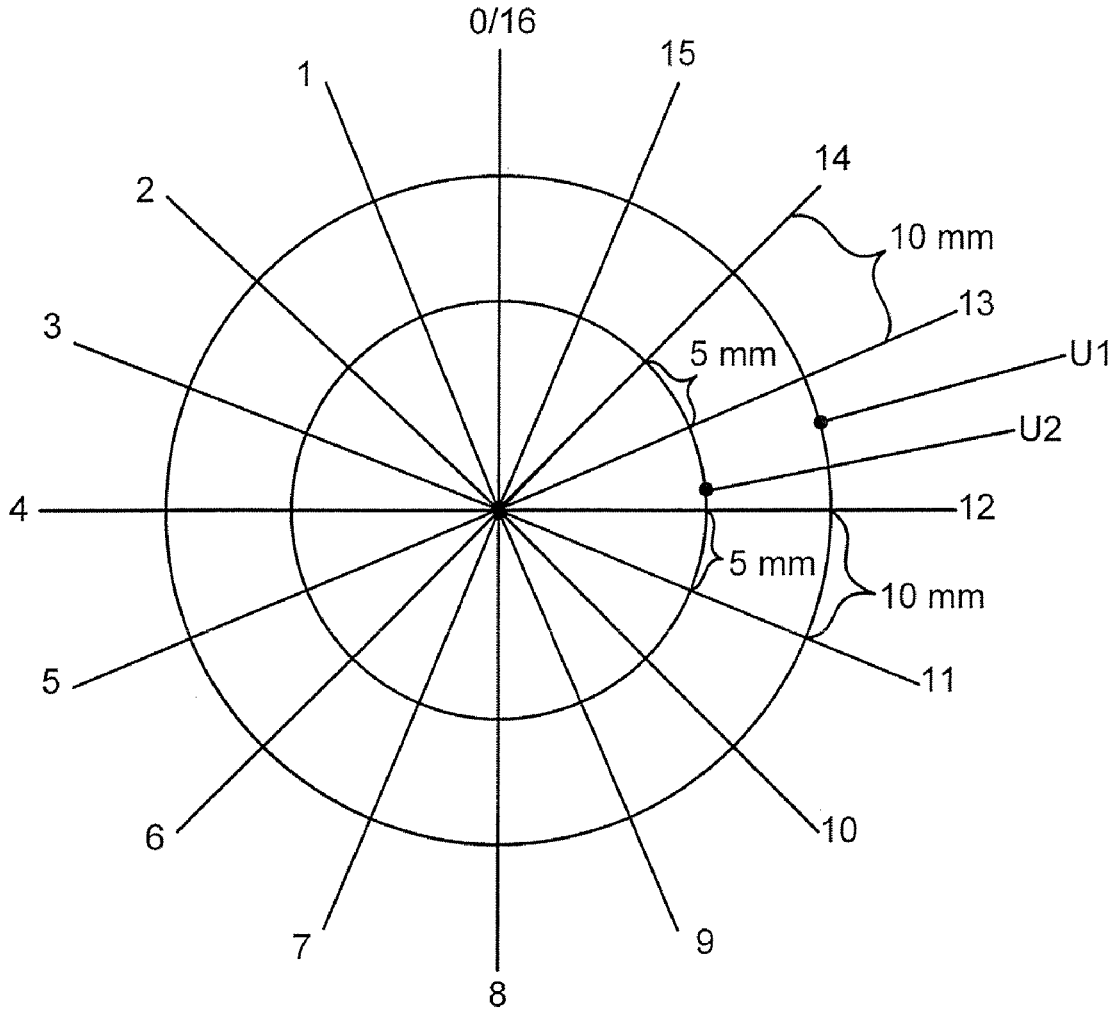
FIG. 2 is a schematic drawing of how 360° can be divided into increments of equal size about the rotational axis of a cloth roller.

FIG. 2 is a schematic drawing of a face view of one of the two cloth rollers, for example the clean cloth roller 8. Its face side is divided about its rotational axis 34 over 360° into the said predefined number of increments of equal size. The larger the number of increments, the higher the accuracy of the cloth feed control is. For example, 360 increments or 720 increments can be provided. For the sake of a clear presentation of this principle, FIG. 2 shows only 16 increments 0 to 16. The cloth feed length, which is transported by one increment during one rotation of the cloth roller 8, is a function of the outer cloth roller diameter or radius. The control element 42 calculates the cloth roller circumference from the measured radius. Let us assume, as an example, that given a cloth roller circumference U1 the cloth roller section between two increments is 10 mm. Furthermore, let us assume that given a smaller diameter U2 the length of the section of cloth between two increments is only 5 mm. This shows very clearly that for a desired cloth feed length (desired value) of 10 mm the clean cloth roller 8 with the large diameter U1 has to be rotated only one increment further, whereas with the small diameter U2 it has to be rotated by two increments in order to unroll the same cloth feed length from the cloth roller 8. The same function can be achieved if the analog position sensor 30 does not detect the clean cloth roller 8, but rather the dirty cloth roller 10.

Decimal amounts may be the result of calculating in the control element 40 by how many increments the clean cloth roller 8 has to be rotated in order for the drive unit 11 to transport, given a calculated size of the circumference, the cleaning cloth 12 by a cloth feed length that corresponds to the desired value. The control element 40 can be designed in such a manner that it always rounds these decimal amounts up or down, or can be designed in such a manner that starting from a predetermined decimal value of, for example, 0.5, it rounds up to the nearest whole number, otherwise rounds down to the nearest whole number.

There are a plethora of possibilities for recognizing by how many increments the cloth roller 8 or 10 was rotated altogether during each cloth feed or starting from a defined start position for all cloth feeds. If the dirty cloth roller 10 is driven by an electric stepper motor, there is the possibility of counting the control pulses and, thus, the individual steps of the stepper motor as the increments in an automatic counter and of storing them in a memory unit. Another possibility of counting and storing increments lies in the use of an encoder 44. It can be arranged to count the increments (rotation steps) of the dirty cloth roller 10 or the clean cloth roller 8. The counting of the increments on the clean cloth spindle 8 is more accurate than on the dirty cloth roller 10, owing to the capacity of the cleaning cloth 12 to stretch and owing to the clearance between the individual elements. As one of the possibilities, FIG. 1 shows an encoder 44, which exhibits an encoder disk 46, which is provided with increment markings 45 (lines, holes, etc.), and an encoder sensor 47 for detecting the increment markings 45. The encoder sensor 47 is connected to the control element 40 in order to deliver to said element an electric signal upon each detection of an increment marking 45. The increment disk 46 is connected to the dirty cloth roller 10 (or the clean cloth roller 8) by way of a connecting element 48 for the purpose of a joint rotation. The connecting element is connected, for example, to a coupling element, which is connected or can be connected to the winding core 28 of the dirty cloth roller 10 (or the clean cloth roller 8). The increment markings 45 can be provided, instead of on the encoder disk 46, on another rotation element, which is connected to the respective cloth roller 10 or 8 directly or via a step-down or step-up ratio.

The control element 40 includes preferably a summation counter 50 for counting the total number of increments or increment markings 45, by which the dirty cloth roller 10 and, thus, also the clean cloth roller 8 was rotated since an initial start for all forward movements of the cloth feed lengths that had been executed to date. The total number of increments that have already been rotated can be used for a number of different purposes. It is a measure for how much cleaning cloth has already been wound on the dirty cloth roller 10 from the clean cloth roller 8 and also for how much length of remaining cloth is still on the clean cloth roller. There is the advantageous possibility of indicating automatically by visual means the total number of increments or a measure of length that is equivalent to this total number either the length of cloth that has already been unwound from the clean cloth roller 8 or the length of the remaining cloth that is still on said roller. Furthermore, there is the possibility of generating an optical or acoustic signal, when only a predefined minimum length of remaining cloth is left on the clean cloth roller 8. The minimum length of remaining cloth can be important for whether it is still sufficient to carry out all of the cleaning processes during one printing process or whether a new clean cloth roller 8 is necessary in order to carry out a printing process without interruption.

The analog position sensor 30 and/or the encoder 44 is/are disposed preferably on the cleaning device 4-1 and/or 4-2 and form together with said cleaning device a module that can be installed in a printing machine. The control element 40 can also be disposed on the cleaning device, but is preferably arranged in such a manner that it is separate from said cleaning device.

A printing machine usually includes a plurality of cleaning devices 4-1, 4-2 etc. (washing beams) for cleaning a plurality of printing machine cylinders 6-1, 6-2 etc. It is desirable to change simultaneously the cleaning cloths 12 in all cleaning devices 4-1, 4-2 etc., so that the printing operation does not have to be interrupted several times. The invention offers the possibility of comparing the total number of increments that have been counted and stored since the cloth feeds were initially started in all cleaning devices 4-1 and 4-2 and of modifying the actuating signal-desired value for the drive unit 11 in such a manner that varying total numbers of increments can be corrected again. Therefore, according to a preferred embodiment of the invention, the control elements 40 of all cleaning devices 4-1 and 4-2 are designed for generating a differential signal from the actual value of the total number of counted increments of their summation counter 50 and from an increments-total number-desired value. The increments-total number-desired value is the average value of several cleaning devices 4-1 and 4-2 in a printing machine, which is obtained by adding the total number of counted increments of the summation counters 50 of all cleaning devices 4-1 and 4-2 and then by dividing the addition value by the number of cleaning devices 4-1 and 4-2.

This calculation can be executed preferably automatically or by a person who reads the total number of counted increments of the summation counters 50 from a summation counter display or from a printout, then adds and divides the addition value by the number of cleaning devices, and then enters the increments-total number-desired value that has been calculated in this manner into the control elements 40. The control elements 40 of all cleaning devices 4-1 and 4-2 are designed for generating a corrected actuating signal-desired value, which, instead of the original desired value, is effective for the predefined cloth feed length, in the event that the differential signal deviates from a predefined allowable differential value. This differential value can be 0 or have another value.

A preferred embodiment of the invention provides a control unit combination, which exhibits two or more cloth feed control units 2-1 and 2-2 for correspondingly two or more cleaning devices 4-1, 4-2 etc. in a printing machine, and which is designed for automatically calculating and applying the increments-total number-desired value.

The control unit combination includes a comparator 60, which is connected to the control elements 40 of all cleaning devices 4-1, 4-2 etc. and exhibits a summation memory 62. The comparator 60 includes a computer 64, which adds up the total number of increments of the summation counters 50 of all control elements 40 to form a total number, stores it in the summation memory 62 and then divides the stored total number of counted increments by the number of all control elements 40, which is equivalent to the number of cleaning devices 4-1, 4-2 etc., and thus forms an average value, which is fed from the comparator 60 in the form of the increments-total number-desired value to all control elements 40. The control elements 40 form from this value the differential signal between this increments-total number-desired value and the actual value of the total number of counted increments of its summation counter 50.

Preferably the corrected actuating signal-desired value is limited to a minimum value, so that it is ensured that at each feed increment provided according to a cleaning program, the cleaning cloth 12 is actually transported by a predefined minimum number of increments. Thus, it is ensured that at each feed increment provided according to the cleaning program, a cloth feed actually takes place and, in so doing, a fresh section of cloth is brought into contact with the printing machine cylinder 6-1 or 6-2, even if the calculated differential signal yields a corrected actuating signal-desired value, for which no cloth feed at the next feed increment would take place.

The invention claimed is:

1. Cloth feed control unit of a cleaning device for printing machine cylinders, comprising:

a cleaning device designed for rotational positioning of two cloth rollers, one cloth roller being a clean cloth roller and the other cloth roller being a dirty cloth roller, the dirty cloth roller being driven step-by-step by an automatic drive unit in order to transfer a cleaning cloth in a step-by-step manner by a predetermined cloth feed length from the clean cloth roller to the dirty cloth roller, the predetermined cloth feed length corresponding to a desired value, the two cloth rollers having variable roller diameters, a non-contact position sensor, which is designed for generating signals linearly in proportion to radial variations in a distance from the outer circumference of one of the two cloth rollers to the position sensor, the position sensor being positioned radially with respect to a rotational axis at a predetermined radial distance from a rotational axis of at least one of the cloth rollers, so that the signals correspond to a respective radius of at least one of the cloth rollers;

an encoder having a rotation element that is in joint rotation and connected to at least one of the cloth rollers, and the encoder further having an encoder sensor for detecting the rotational element;

a control element, having the encoder sensor connected thereto, the control element calculates a respective size of the circumference of at least one of the respective cloth rollers from the signals of the position sensor, the respective size corresponds to the radius of at least one of the respective cloth rollers; the control element further being able to store a cloth feed length-desired value; and a predefined number of rotational angle-increments for the 360[deg.] circumference of at least one of the cloth roller;

the control element being able to calculate how many increments at least one of the cloth roller has to be rotated in order for the drive unit to transport the cleaning cloth by one cloth feed length, which corresponds to the cloth feed length desired value, given the calculated respective size of the circumference of the respective cloth roller, and the control element further being able to generate an actuating signal-desired value for the drive unit which corresponds to the calculated increments.

2. Cloth feed control unit, as claimed in claim 1, characterized in that the control element calculates how many increments at least one of the cloth roller has to be rotated in order for the drive unit to transport and in the event that the calculation of the increments does not yield an integral number, the control element will either round these decimal amounts up or down, or starting at a predetermined decimal number round up to the nearest whole number, otherwise rounds down to the nearest whole number and the control element generates a correspondingly rounded up or rounded down actuating signal-desired value.

3. Cloth feed control unit, as claimed in claim 1, characterized in that the control element rounds up decimal numbers to an integral number in the event that the calculation of the increments does not yield an integral number, and the control element generates a correspondingly rounded up actuating signal-desired value.

4. Cloth feed control unit, as claimed in claim 1, characterized in that the control element rounds down decimal numbers to an integral number in the event that the calculation of the increments does not yield an integral number, and the control element generates a correspondingly rounded down actuating signal-desired value.

5. Cloth feed control unit, as claimed in claim 1, whereas the encoder detects rotational angle increments of one of the two cloth rollers at each of the detected rotational angle increments, and the encoder generates an electric signal and sends the signal to the control element and during one cloth feed increment the control element switches off the cloth feed, when the signals of the encoder correspond to the actuating signal-desired value.

6. Cloth feed control unit, as claimed in claim 5, whereas the encoder exhibits increment markings, which are distributed, according to the increments of the cloth roller, over 360[deg.] about the rotational axis of the rotation element, which rotates in synchronism with the cloth roller.

7. Cloth feed control unit, as claimed in claim 1, whereas the control element further includes a summation counter for counting the total number of increments, by which the cloth roller was rotated since an initial start.

8. Cloth feed control unit, as claimed in claim 7, whereas the control element generates a differential signal from the difference between the actual value of the total number of counted increments of the summation counter and from an increments-total number-desired value and, furthermore, generates a corrected actuating signal-desired value, in the event that the differential signal deviates from a predefined allowable differential value.

9. Cloth feed control unit, as claimed in claim 1, whereas the position sensor is an ultrasonic sensor.

10. Cloth feed control unit, as claimed in claim 1 further including a plurality of cloth feed control units, corresponding with a plurality of cleaning devices in a printing machine, a comparator, having a summation memory and is connected to summation counters of the control elements of all cloth feed control units the comparator counts the total number of counted increments of all summation counters, stores the total in the summation memory and divides the total number of all counted increments of all control elements by the number of control elements of all cleaning devices to calculate an average value as an increments-total-desired value, which is fed to all control elements.

11. Cloth feed control unit, as claimed in claim 10, further including a corrected actuating signal-desired value that is limited to a minimum value to ensure that at each feed increment provided the cleaning cloth is actually transported by a predefined minimum number of increments.

12. Cloth feed control unit, as claimed in claim 1 further including at least one cleaning device for at least one printing machine cylinder.

13. Cloth feed control method in a cleaning device for cleaning printing machine cylinders, comprising:

generating signals by a non-contact position sensor which generates the signals linearly in proportion to radial variations in a distance from a cloth roller periphery to the position sensor by an ultrasonic sensor;

detecting a radial distance to a peripheral surface of one cloth roller of two cloth rollers, whereas the one cloth roller is a clean cloth roller, forming a signal, corresponding to the radius of the cloth roller;

that with this signal, corresponding to a cloth radius, the cloth circumference is calculated automatically by a control element;

calculating from the calculated cloth circumference how many angle increments the one cloth roller has to be rotated by a drive unit in order to move a cleaning cloth from the clean cloth roller to a dirty cloth roller by a predefined feed length corresponding to a cloth feed length-desired value during a cloth feed increment.

14. Cloth feed control method, as claimed in claim 13, further including detecting the rotational angle-increments of at least one of the two cloth rollers, by an encoder and storing the sum-actual value of the detected rotational angle-increments in a summation memory of the control element.

15. Cloth feed control method, as claimed in claim 14, further including automatically adding a stored sum-actual values of all summation memories of two or more cleaning devices in a printing machine calculating an average desired value for the number of increments already traveled by dividing the total sum value by the number of cleaning devices;

forming for each cleaning device the difference between the average-desired value and the sum actual value of the rotational angle increments that have been traveled and storing a differential value;

automatically compensating at least to some degree the difference by a corresponding automatic change in control variable for cloth feed drive in the event the difference deviates from a defined limit value in one or more of the cleaning devices during at least one of the next cloth feeds.

* * * * *